US005944084A

United States Patent [19]

Cadorette

[11] Patent Number: 5,944,084

[45] Date of Patent: Aug. 31, 1999

[54] VALANCE ASSEMBLY

[75] Inventor: Mario Cadorette, Sainte Thérès, Canada

[73] Assignee: All-Teck Blinds P.T.B. Inc., Montreal, Canada

[21] Appl. No.: 09/137,145

[22] Filed: Aug. 20, 1998

[30] Foreign Application Priority Data

May 14, 1998 [CA] Canada ..... 2237749

[51] Int. Cl.[6] ..... E04F 10/00

[52] U.S. Cl. ..... 160/38; 160/19

[58] Field of Search ..... 160/38, 39, 19

[56] References Cited

U.S. PATENT DOCUMENTS

| | | | |
|---|---|---|---|
| 2,315,033 | 3/1943 | Adair | 160/39 |
| 3,297,075 | 1/1967 | Howell et al. | 160/38 |
| 4,354,300 | 10/1982 | Anderle | 160/38 X |
| 4,935,988 | 6/1990 | Ford et al. . | |
| 4,957,255 | 9/1990 | John | 160/38 |
| 5,042,548 | 8/1991 | Attal | 160/38 |
| 5,330,821 | 7/1994 | Lo | 160/39 |
| 5,660,219 | 8/1997 | Ford et al. | 160/38 |

FOREIGN PATENT DOCUMENTS

| | | | |
|---|---|---|---|
| 834087 | 8/1938 | France | 160/19 |
| 538116 | 11/1931 | Germany | 160/19 |
| 719910 | 3/1942 | Germany | 160/19 |
| 68694 | 8/1951 | Netherlands | 160/19 |

*Primary Examiner*—Blair M. Johnson
*Attorney, Agent, or Firm*—Sughrue, Mion, Zinn, Macpeak & Seas, PLLC

[57] ABSTRACT

A valance assembly for use with a blind having a headrail includes an elongate valance member having a substantially planar rear face. A T-shaped groove is disposed in the rear face of, and oriented longitudinally with respect to the elongate valance member. A pair of valance return members are mounted at opposite ends of the elongate valance member, each valance return member having a substantially planar rear face. A corresponding T-shaped groove is disposed in the rear face of, and oriented longitudinally with respect to each respective valance return member. Each of the valance return members are joined to the elongate valance member by means of a corner bracket capable of sliding frictional engagement into the T-shaped groove of the elongate valance member and a corresponding T-shaped groove of a respective one of the valance return members, so that each valance return member is securely retained in position by frictional engagement between a respective corner bracket and corresponding T-shaped grooves of the elongate valance member and the respective valance return member. Finally, at lease one valance support is provided for releasably engaging the T-shaped groove of the elongate valance member and an upper portion of the headrail, in order to support the elongate valance member in generally parallel spaced relation to the headrail.

7 Claims, 4 Drawing Sheets

VALANCE ASSEMBLY

BACKGROUND OF THE INVENTION

This invention relates to a valance assembly for use in conjunction with a window blind.

It is common to employ a valance assembly with venetian and vertical blinds, in order to conceal the blind headrail, which tends to be unattractive. Typically, the valance assembly comprises an elongate valance front element which is mounted in front of the blind headrail, and a pair of valance returns mounted at opposite ends of the valance front element. In order to support the valance assembly, two types of mounting system are conventionally used, as described below.

In one arrangement, the valance returns are fastened to a wall at opposite ends of the blind headrail using respective mounting brackets which are designed for that purpose. The mounting brackets are typically formed as a specially designed steel stamping, and are secured to the wall using screws. The valance front element is then secured to the valance returns using additional corner brackets or clips, so that the valance front element is supported at either end by the valance returns.

This arrangement suffers from numerous disadvantages. In particular, at least two different types of specially designed brackets must be provided. Since these brackets must be separately designed, manufactured and maintained in inventory, the total cost of the valance assembly is increased. Furthermore, since the valance front element is supported only at its ends, it must be designed with reinforcements or stiffeners to prevent sagging or twisting, which tends to increase both its weight and cost. In some cases, particularly with wide windows, it becomes necessary to provide one or more additional brackets designed to support the front valance member at various points along its length. These additional brackets must be specially designed and manufactured, thereby further increasing costs.

An alterative arrangement for mounting the valance is to secure the valance front element to a wall or ceiling using a number of brackets. The valance returns are mounted at either end of the valance front element using special brackets or clips designed for that purpose.

This arrangement also suffers from the disadvantage that at least two sets of specially designed brackets must be provided, thereby increasing costs. Often, the mounting brackets used to support the valance are also used to support the blind headrail. This improves efficiency somewhat, but at the price of increasing the size and complexity (and thus the cost) of the mounting brackets.

SUMMARY OF THE INVENTION

An object of the present invention is to provide a valance assembly which is inexpensive, and readily installed on-site without requiring special tools or training.

Another object of the invention is to provide a valance assembly which is fully self-supporting, without adhesives, nails, screws or similar fastening means.

Accordingly, an aspect of the present invention provides, in a valance for a blind, an elongate valance member comprising a contoured decorative front surface, a substantially planar rear surface, and a T-shaped groove disposed in the rear surface and oriented longitudinally of the valance member. In an embodiment of the invention, the valance member has a single T-shaped groove disposed equidistant from opposite longitudinal edges of the member. In an alternative embodiment, two or more T-shaped grooves are disposed on the rear surface of the valance member.

A further aspect of the present invention provides, in a blind having a headrail, a valance assembly comprising an elongate valance member having a substantially planar rear face. A T-shaped groove is disposed in the rear face of, and oriented longitudinally with respect to the elongate valance member. A pair of valance return members are mounted at opposite ends of the elongate valance member. Each valance return member has a substantially planar rear face, and a corresponding T-shaped groove disposed in the rear face of, and oriented longitudinally with respect to each respective valance return member. A corner bracket is capable of sliding frictional engagement into the T-shaped groove of the elongate valance member and a corresponding T-shaped groove of a respective one of the valance return members. By this means, each valance return member is securely retained in position by frictional engagement between a respective corner bracket and corresponding T-shaped grooves of the elongate valance member and the respective valance return member. Finally, at least one valance support is capable of releasably engaging the T-shaped groove of the elongate valance member and an upper portion of the headrail, for supporting the elongate valance member in generally parallel spaced relation to the headrail.

A further aspect of the present invention provides, in a blind having a headrail and a valance, the valance being characterized by a longitudinal T-shaped groove disposed in a rear surface of the valance, a valance support comprising a support arm capable of releasable engagement with an upper portion of the headrail. A front wall member is disposed on a free end of the support arm. A pair of spaced apart spacer members extend rearwardly from the front wall member, for maintaining the front wall member in a generally parallel spaced relation to a wall of the blind headrail. Finally, a pair of opposed resilient tabs extend outwardly from the front wall member, for cooperatively engaging opposed walls of the T-shaped groove of the valance, so as to retain the rear surface of the valance in abutting contact with the front wall member of the valance support.

A still further aspect of the present invention provides a kit for assembling a valance for a window blind, the kit comprising a first extrusion, a second extrusion and a pair of corner brackets. The first extrusion includes a decorative face and a rear face having a T-shaped groove formed therein, and is capable of forming a front valance member and valance returns by suitable cutting of the first extrusion. The second extrusion is capable of being cut transversely into suitably sized pieces for forming a plurality of support brackets designed to support the front valance member in generally parallel spaced relation to a headrail of the window blind. The corner brackets are capable of sliding frictional engagement with the T-shaped groove of the first extrusion, for securely supporting the valance returns to opposite ends of the front valance member without the need for screws or other fastening means.

Preferably, the first extrusion forming the front valance member and the valance returns is composed of foamable thermoplastic resin, such as, for example, PVC. Materials of this type offer a wide range of colors, and can be cleanly cut and shaped with conventional woodworking tools. Thus the front valance member and valance returns can be custom-fitted, on site, by a reasonably competent tradesman without special tools or training.

In an embodiment of the invention, the first extrusion forming the front valance member and the valance returns is composed of a mixture of at least two batches of foamable thermoplastic resin having respective different colors and/or hues, the batches of thermoplastic resin being mixed together during formation of the first extrusion so that the exterior surface thereof has a multi-colored appearance. In an embodiment of the invention, the colors and/or hues of the batches of thermoplastic resin are selected and mixed to provide the exterior surface of the first extrusion with a wood-grain appearance.

In an embodiment of the invention, the T-shaped groove is disposed equidistant from opposite longitudinal edges of the first extrusion.

In an embodiment of the invention the second extrusion is used to make valance supports, each of which comprises a support arm capable of releasable engagement with an upper portion of the headrail. A front wall member is disposed on a free end of the support arm. A pair of spaced apart spacer members extend rearwardly from the front wall member, for maintaining the front wall member in a generally parallel spaced relation to a wall of the blind headrail. Finally, a pair of opposed resilient tabs extend outwardly from the front wall member, for cooperatively engaging opposed walls of the T-shaped groove, so as to retain the rear surface of the first extrusion in abutting contact with the front wall member of a valance support formed from the second extrusion.

The second extrusion can conveniently be composed of thermoplastic resin, such as, for example, PVC, which can readily be cut on-site using conventional woodworking tools.

The present invention offers the following advantages:

1. a custom-fitted window valance can be constructed either in a manufacturing plant or on-site without the need for special tools, equipment, or training;
2. a minimum number of parts need to be retained in inventory and/or supplied to the customer;
3. the materials for the window valance can be easily mass-produced at low cost;
4. the window valance can be completely assembled and mounted on a window blind without the use of glue, screws, nails, or other fastening means.

BRIEF DESCRIPTION OF THE DRAWINGS

Further features and advantages of the present invention will become apparent from the following detailed description, taken in combination with the appended drawings, in which.

DETAILED DESCRIPTION

Figure 1:
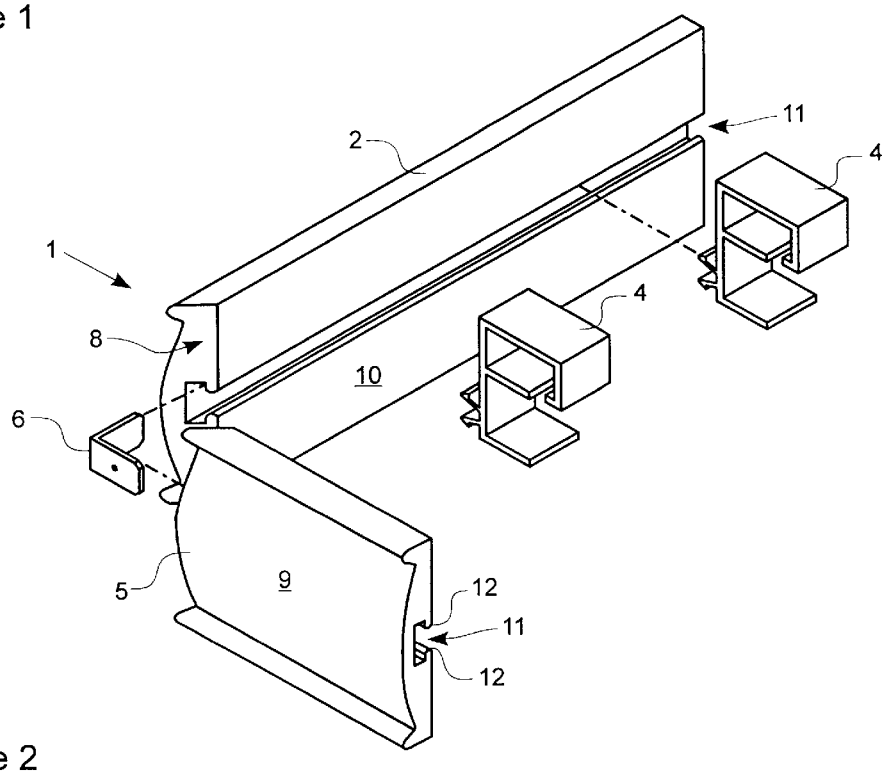
FIG. 1 is a an exploded perspective view of a valance assembly in accordance with an embodiment of the present invention.
Figure 2:
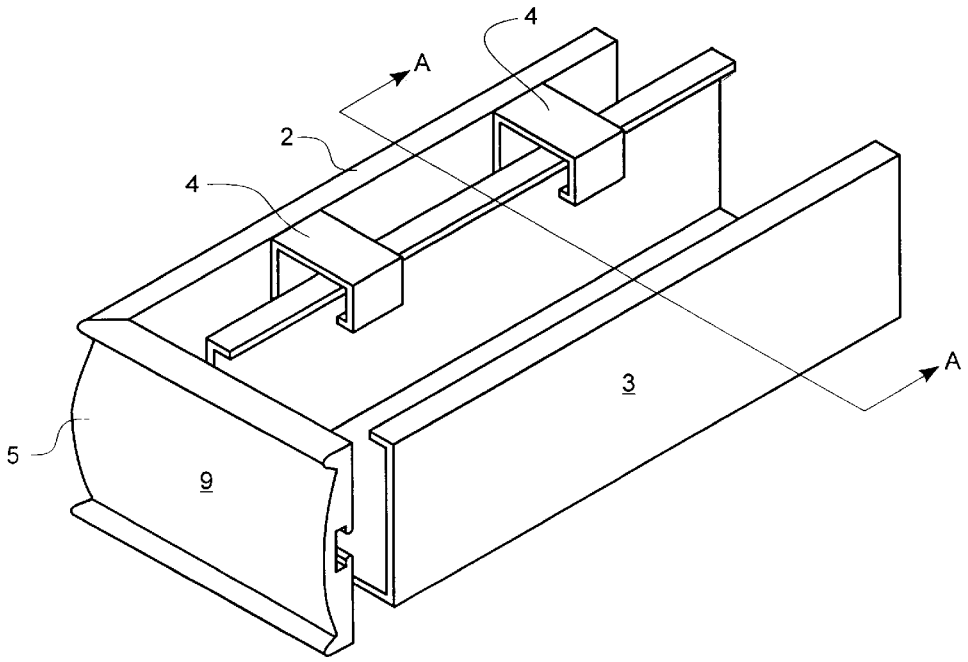
FIG. 2 is a perspective view of the embodiment of FIG. 1 mounted on a head rail of a venetian-type blind.
Figure 3:
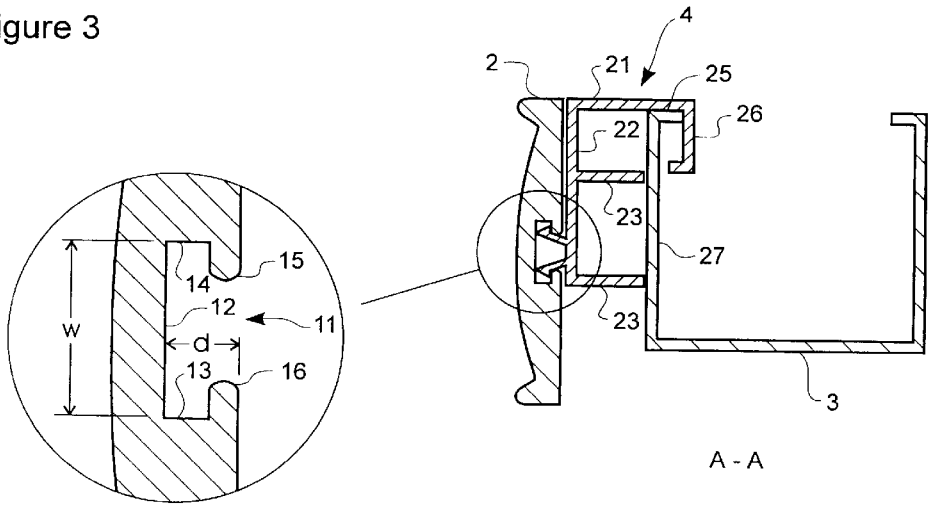
FIG. 3 is a cross-sectional view taken along line A—A of FIG. 2.

Referring now to FIGS. 1 to 3, a valance assembly 1 in accordance with an embodiment of the present invention comprises an elongate front valance member 2 which can be mounted on a headrail 3 of a window blind by means of two or more valance supports 4. A valance return 5 (only one is shown in the figures) is mounted on each end of the front valance member 2 by means of a respective corner bracket 6.

Figure 6:
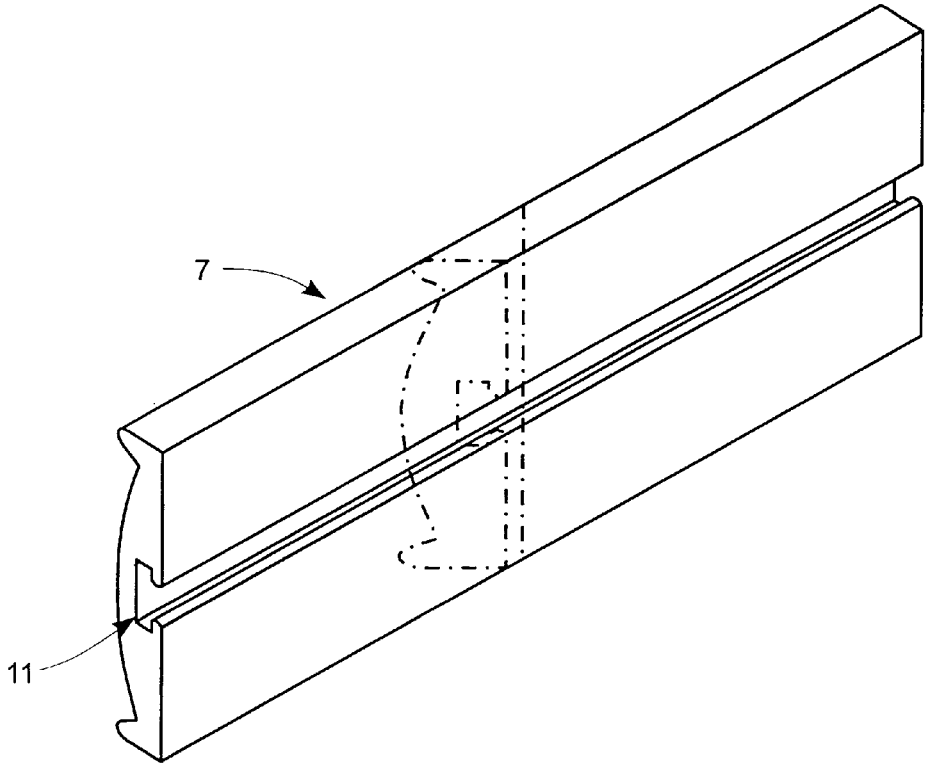
FIG. 6 is a perspective view of a valance extrusion usable in a valance kit in accordance with an embodiment of the present invention.

As may be best seen in FIGS. 1 and 3, the front valance member 2 and the valance returns 5 have a substantially constant cross-sectional shape, and thus can conveniently be cut from a common piece of valance stock 7 (see FIG. 6). In order to minimize manufacturing cost, the valance stock 7 can be manufactured as a continuous extrusion, which may be cut to convenient lengths for shipping and storage. In principle, the front valance member 2 and the valance returns 5 may be manufactured of any material providing acceptable properties of strength, rigidity, and visual appearance. Preferably, the front valance member 2 and the valance returns 5 are formed of a thermoplastic resin, such as, for example, Polyvinylchloride (PVC), which offers adequate strength and rigidity, a wide range of colors, and low manufacturing costs. In order to reduce weight, a foamable thermoplastic resin can be used (such as, for example, by adding known foaming agents to the molten PVC prior to extrusion through a die). This results in low-density valance members having a foamed interior, while retaining a smooth exterior surface.

One particularly advantageous feature of foamed PVC front valance member 2 and the valance returns 5 is that they can be readily cut and shaped using conventional woodworking tools and yields a smooth, high-quality cut end 8. Thus the front valance member 2 and the valance returns 5 can be cut on site (using, for example, a conventional miter-box), by tradesmen of average skill, and produce high quality close fitting joints between the front valance member 2 and the valance returns 5.

Conveniently, the front valance member 2 and the valance returns 5 are provided with a contoured, decorative front face 9, to enhance the visual appearance of the finished valance 1. In order to further enhance the visual appearance of the valance 1, the front valance member 2 and the valance returns 5 can be formed from a mixture of two or more batches of material, each having a selected color or hue. These batches can be mixed together in various known ways during extrusion of the valance stock 7 to produced a desired striped appearance. For example, by using batches of material having different shades of brown, a valance 1 having the appearance of wood grain can be manufactured.

Conveniently, the rear face 10 of the front valance member 2 and the valance returns 5 is generally planar. A T-shaped groove 11 having a base wall 12, opposed interior side walls 13, 14 and opposed groove overhang portions 15, 16 (see FIG. 3) runs continuously throughout the length of the valance stock 7 from which the front valance member 2 and the valance returns 5 are made. As a result, when a front valance member 2 and valance returns 5 are cut from the valance stock 7, the T-shaped grooves 11 of both components will align precisely. In general, the width "w", and depth "d" of the T-shaped groove 11 can be any convenient dimensions. However, it is desirable that the width "w" of the T-shaped groove 11 be made large enough that a corner bracket 6 inserted into the groove will be able to stabilize the front valance member 2 and valance returns 5 against relative movement. Thus it is preferable for the width "w" of the T-Shaped groove 11 to be between 10 mm and 15 mm, preferably 12.5 mm. Similarly, the depth "d" of the T-shaped groove 11 should be selected so that the groove overhang portions 15, 16 have sufficient thickness to provide adequate strength, and so prevent a corner bracket 6 from "breaking out" of the T-shaped groove 11. When the front valance member 2 and the valance returns 5 are composed of foamed PVC, a total depth "d" of between 4 mm and 8 mm, preferably 5 mm is found to be suitable.

Figure 4:
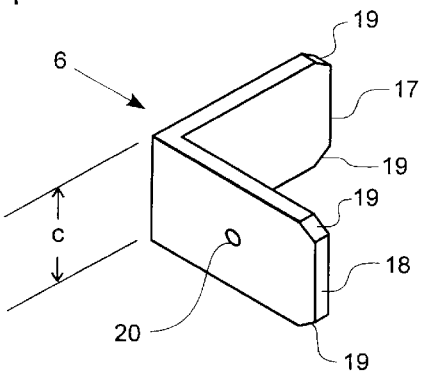
FIG. 4 is an enlarged perspective view of a corner bracket illustrated in the embodiment of FIG. 1.

Referring now to FIG. 4, each corner bracket 6 is formed as a pair of arms 17, 18 arranged at right-angles to one another. The corner bracket 6 can be constructed of any suitable material, such as, for example, steel or aluminum, which offers suitable properties of strength and rigidity. Conveniently, the corner bracket 6 can be formed by cutting a piece having a suitable length from rolled or extruded angle-stock. This ensures that the corner bracket 6 can be formed from low cost stock material and minimizes variation in the angle between the arms 17, 18. Furthermore, this method eliminates any corner radius which would inevitably result from attempting to bend a straight piece of material to form the two arms. Such a corner radius would interfere with obtaining a close fitting joint between the front valance member 2 and the valance returns 5 during assembly of the valance.

Each arm 17, 18 of the corner bracket 6 is designed to slide into the T-shaped grooves 11 of the front valance member 2 and valance returns 5. Preferably, the width "c" of the arms 17, 18 is slightly larger than the width "w" of the T-shaped groove 11, so as to create an interference fit with the interior walls 13, 14 of the T-shaped groove 11. This ensures that friction between the corner bracket 6 and the walls 13, 14 of the T-shaped groove 11 will retain the front valance member 2 and the valance returns 5 securely in position, and will combine with the natural stiffness of the corner bracket material to stabilize the valance returns 5 against undesirable movement with respect to the front valance member 2. In order to facilitate insertion of the corner bracket arms 17, 18 into the T-shaped groove 11, free ends of the arms 17, 18 are provided with chamfered or radiused corner edges 19, which serve to prevent binding. A raised portion 20 formed on the outer face of each arm 17, 18 enhances frictional engagement between the corner bracket 6 and the base wall 12 of the T-shaped groove 11.

Figure 5:
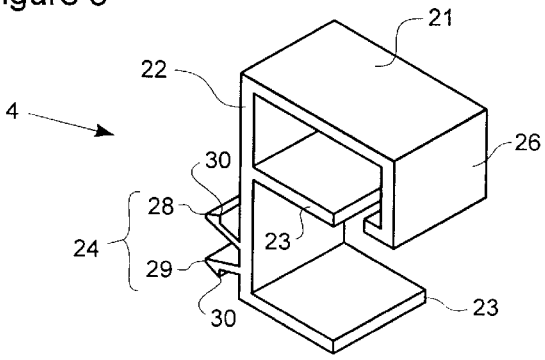
FIG. 5 is an enlarged perspective view of a valence support illustrated in the embodiment of FIG. 1.
Figure 8:
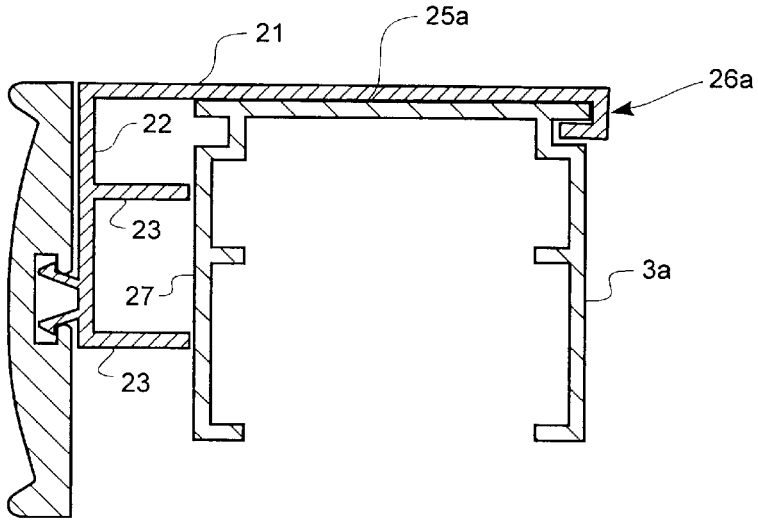
FIG. 8 is a cross-sectional view showing an embodiment of the present invention adapted for use with a vertical blind.

As shown in FIG. 5, the valence support 4 includes a support arm 21, a front wall member 22, one or more spacer members 23 (two are shown in the illustrated embodiment), and a valance latch 24. The support arm 21 is designed for releasable engagement with an upper portion of the headrail 3 of a blind. In the embodiment illustrated in FIGS. 1–3 and 5, the support arm 21 is designed to lay across an upper surface 25 of a venetian blind headrail 3, and includes a hook portion 26 which extends downward into the interior of the headrail 3. In an alternative embodiment, illustrated in FIG. 8, the support arm 21 extends entirely across the upper surface 25*a* of a vertical blind headrail 3*a*, and includes a hook portion 26*a* which extends downward to engage an opposite side of the headrail 3*a*. In either embodiment, the hook portion 26 of the support arm 21 engages the headrail 3 to secure the valance support 4 in place on the headrail 3, without interfering with either the headrail mounting brackets (not shown), or the blind mechanism (not shown) within the headrail 3. The front wall member 22 is disposed on a free end of the support arm 21, opposite the hook portion 26, and is arranged to hang essentially parallel to a front surface 27 of the blind headrail 3. In order to stabilize the front wall member 22, one or more spacer members 23 (two are shown) extend rearwardly from the front wall member 22 and abut the front surface 27 of the headrail 3. These spacer members 23 also cooperate with the hook portion 26 of the support arm 21 to help secure the valance support 4 on the blind headrail 3. The valance latch 24 comprises a pair of opposed resilient tabs 28, 29 which extend outwardly from the front wall member 22. As shown in FIGS. 3 and 5, the resilient tabs 28, 29 are positioned spaced apart on the front wall member 22, and angle away from each other so that they can be resiliently deformed to allow the free ends of the tabs to be inserted into the T-shaped groove 11 of a valance member. Once inserted, the resilient tabs 28, 29 spring outward and bear against the interior of the T-shaped groove 11 to securely hold the valance member in place. In order to more securely retain the valance member in place, free ends of the resilient tabs 28, 29 can be provided with suitable respective hook portions 30, as shown in FIGS. 3 and 5.

Figure 7:
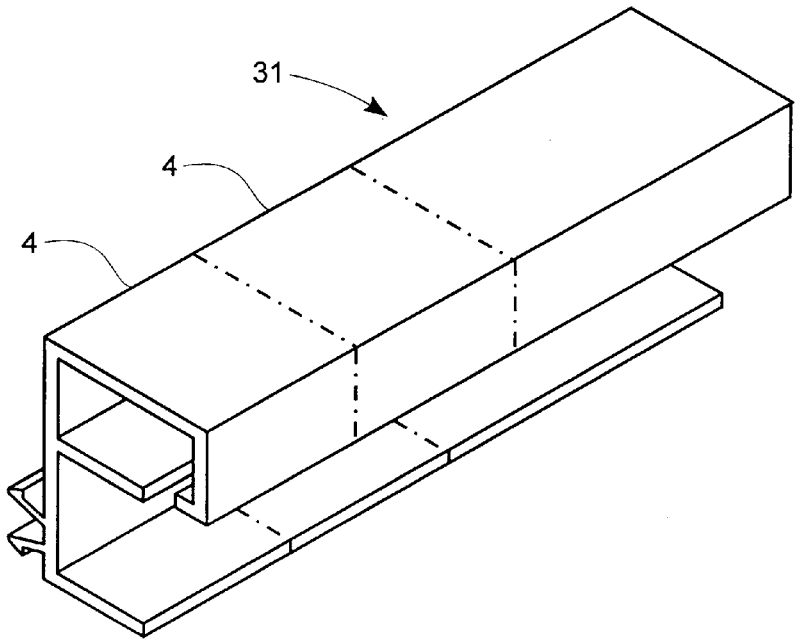
FIG. 7, is a perspective view of a support extrusion usable in a valance kit in accordance with an embodiment of the present invention.

The valance support 4 can be formed of any suitable material providing adequate, strength, rigidity and resilience. Conveniently, the valance support 4 can be composed of a thermoplastic resin, such as, for example PVC. Still more conveniently, the valance support 4 can be manufactured from a continuous extruded support stock 31 (See FIG. 7), which can be cut transversely at suitable intervals to make plural valance supports.

In use, a length of valance stock 31 can be cut into suitable lengths (as indicated by the dotted lines in FIG. 6) to create a front valance member 2, and a pair of valance returns 5. By angling the cuts at 45° (using, for example, a conventional miter-box), a clean, right-angled "picture-frame" joint between the front valance member 2 and the valance returns 5 can be created.

The valance 1 is then assembled by inserting the arms 17, 18 of the corner brackets 6 into the open ends of the T-shaped slots 11 of the front valance member 2 and the valance returns 5, as illustrated in FIG. 1. Because of the ability of the foamed PVC material of the front valance member 2 and the valance returns 5 to produce a clean, high quality cut, and the constant cross section of the valance stock 7, a precise alignment and a close-fitting joint between the front valance member 2 and the valance returns 5 can be created. This feature, coupled with the high friction interference fit between the corner brackets 6 and the interior walls 12–14 of the T-shaped grooves 11, means that the valance 1 can be completely assembled without the need for adhesives, screws, nails or other fastening means to secure or fill the joints between the front valance member 2 and the valance returns 5. Consequently, assembly of the valance 1 is quick and inexpensive, and tradesmen of average skill can produce a high-quality finished product.

During or after installation of the blind headrail 3, two or more valance supports 4 are mounted onto the headrail 3 at desired locations. The assembled valance 1 can then be pressed against the valance supports 4 so that the T-shaped groove 11 of the front valance member 2 latches onto, and is secured by, the resilient tabs 28, 29 of the valance supports 4 to thereby securely attach the assembled valance 1 to the blind headrail 3.

It is customary to manufacture custom fitted window blinds and valances in a factory or shop on the basis of measurements previously taken by a salesman. A tradesman, is then sent to the client's premises to install the blinds and valances. This arrangement requires that the manufacturing plant or shop maintain all of the various valance components, brackets and fasteners in stock, which tends to increase the cost of custom-fitted valances produced by the manufacturing plant.

As mentioned previously, in accordance with the present invention, it is convenient to fabricate the valance members and valance supports from continuous lengths of extruded stock. Identical corner brackets are then used for assembling the valance together, and additional fasteners (nails, screws or the like) are not required. Thus by using the present invention, the variety of different components which must be retained in inventory is reduced, thereby simplifying inventory management, and reducing overhead costs.

The present invention also makes it possible to furnish a low-cost kit with which a tradesman, or consumer can fabricate a custom-fitted valance on site. Such a kit could conveniently comprise a long length (for example approximately 2–3 m) of valance stock having desired contours and coloration, a shorter length (for example approximately 15–30 cm) of support member stock, and two corner brackets. Thus the kit would comprise a total of four components, which furnishes everything required to fabricate a custom fitted valance on-site using standard wood-working tools and methods.

I claim:

1. A kit for assembling a valance for a window blind, the kit comprising:

(a) a first elongate member having a constant cross-section and including a decorative face and a substantially planar rear face having a T-shaped groove formed therein substantially equidistant from opposite longitudinal edges of the first elongate member, the first elongate member being capable of forming a front valance member and valance returns by cutting of the first elongate member;

(b) a second elongate member having a constant cross-section and capable of being cut transversely to form a plurality of support brackets designed to support the front valance member in operative relation to a headrail of the window blind; and (c) a pair of corner brackets capable of sliding frictional engagement with the T-shaped groove of the first elongate member, for securely supporting the valance returns to opposite ends of the front valance member, each corner bracket being designed such that in use the corner bracket provides the sole means of retaining a respective valance return in assembled relation to the front valance member, and the corner bracket is fully concealed behind the front valance member and the respective valance return.

2. A kit as claimed in claim 1, wherein the first elongate member is composed of foamable thermoplastic resin.

3. A kit as claimed in claim 2, wherein the foamable thermoplastic resin is PVC.

4. A kit as claimed in claim 2, wherein the first elongate member is composed of a mixture of at least two batches of foamable thermoplastic resin having respective different colors and/or hues, the batches of thermoplastic resin being mixed together during formation of the first elongate member so that the exterior surface thereof has a multi-colored appearance.

5. A kit as claimed in claim 4, wherein the colors and/or hues of the batches of thermoplastic resin are selected to provide the exterior surface of the first elongate member with a wood-grain appearance.

6. A kit as claimed in claim 1, wherein the T-shaped groove is disposed equidistant from opposite longitudinal edges of the first elongate member.

7. A kit as claimed in claim 1, wherein the second elongate member comprises:

(a) a support arm capable of releasable engagement with an upper portion of the headrail;

(b) a front wall member disposed on a free end of the support arm;

(c) a pair of spaced apart spacer members extending rearwardly from the front wall member, for maintaining the front wall member in a generally parallel spaced relation to a wall of the blind headrail; and (d) a pair of opposed resilient tabs extending outwardly from the front wall member, for cooperatively engaging opposed walls of the T-shaped groove of the valance, so as to retain the rear surface of the valance in abutting contact with the front wall member of the valance support.

* * * * *